US006863128B2

(12) United States Patent
Pandey et al.

(10) Patent No.: US 6,863,128 B2
(45) Date of Patent: Mar. 8, 2005

(54) METHOD OF PREDICTING FRICTION PRESSURE DROP OF PROPPANT-LADEN SLURRIES USING SURFACE PRESSURE DATA

(75) Inventors: Vibhas Pandey, Sugar Land, TX (US); Curtis L. Boney, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 32 days.

(21) Appl. No.: 10/277,535

(22) Filed: Oct. 22, 2002

(65) Prior Publication Data

US 2003/0078732 A1 Apr. 24, 2003

Related U.S. Application Data

(60) Provisional application No. 60/336,349, filed on Oct. 24, 2001.

(51) Int. Cl.[7] ..... E21B 43/26

(52) U.S. Cl. ..... 166/250.1; 166/250.07; 166/280.1

(58) Field of Search ..... 166/250.01, 250.07, 166/250.1, 280.1, 308.1, 380; 73/152.01, 152.51, 152.39, 152.54

(56) References Cited

U.S. PATENT DOCUMENTS

| | | | | |
|---|---|---|---|---|
| 5,103,905 A | * | 4/1992 | Brannon et al. | 166/250.1 |
| 5,183,109 A | * | 2/1993 | Poulsen | 166/250.1 |
| 5,325,921 A | * | 7/1994 | Johnson et al. | 166/280.1 |
| 5,492,175 A | * | 2/1996 | El-Rabaa et al. | 166/250.01 |
| 5,635,636 A | * | 6/1997 | Alexander | 73/152.29 |
| 5,708,204 A | * | 1/1998 | Kasap | 73/152.52 |
| 6,076,046 A | * | 6/2000 | Vasudevan et al. | 702/12 |

OTHER PUBLICATIONS

Govier, G.W. and Aziz, K.: *The Flow of Complex Mixtures in Pipes*, van Nostrand Rheinhold Co., New York City, (1972), pp 98.

Keck, R.G., Nehmer, W.L., and Strumolo, G.S.: "A New Method for Predicting Friction Pressures and Rheology for Proppant–laden Fracturing Fluids," SPE 19771 presented at the 64$^{th}$ Annual Technical Conference and Exhibition of the Society of Petroleum Engineers held in San Antonio, TX, Oct. 8–11, 1989.

Virk, P.S.,: "Drag Reduction Fundamentals," *AIChE J.* (Jul., 1975) 21. No. 4, 625–656.

Round, G.F. and Kruyer, J.: "Experiments on the Suspension of Spheres in Inclined Tubes–I. Suspension by Water in turbulent Flow," *Chem. Eng. Sci.* (1967) 22, 1133–45.

Molerus, O. and Wellmann, P.: "A New Concept for the Calculation of Pressure Drop with Hydraulic Transport of Solids in Horizontal Pipes," *Chem. Eng. Sci.* (1981) No. 10, 1623–32.

Shah, S.N., Lee, Y.N.: "Friction Pressures of Proppant–Laden Hydraulic Fracturing Fluids," SPE Production Engineering (Nov. 1986) 437–45.

(List continued on next page.)

*Primary Examiner*—Kenn Thompson
(74) *Attorney, Agent, or Firm*—Steve Schlather; Robin Nava; Brigiha L. Echols

(57) ABSTRACT

The present invention relates to a method of determining the proppant friction generated in a fracture of a subterranean formation during a hydraulic fracturing treatment involving injection stages of pad and of proppant-laden fluids. This method is based on close monitoring of surface pressure to define a "net pressure rate" which defines an increase or decrease of net pressure while the job is being pumped, and then relates it with the pressure changes observed with the onset of proppant stages of varying concentrations.

3 Claims, 5 Drawing Sheets

OTHER PUBLICATIONS

Shah, S.N.: "Proppant Settling Correlations for Non–Newtonian Fluids under Static and Dynamic Conditions," *Trans.*, AIME, 273, Part 2 (1982) 164–70.

Lord, D.L. and McGowan, J.M.,: "Real–Time Treating Pressure Analysis Aided by New Correlation," SPE 15367 presented at the 61st Annual Technical Conference and Exhibition of the SPE held in New Orleans, LA, Oct. 5–8, 1986.

Pandey, V.J.: "Friction Pressure Correlation for Guar–Based Hydraulic Fracturing Fluids," SPE 71074 presented at the SPE Rocky Mountain Petroleum Technology Conference held in Keystone, CO, May 21–23, 2001.

Tehrani, M.A.: "An experimental study of particle migration in pipe flow of viscoelastic fluids," J. Rheology 40(6), Nov./Dec. 1996. pp. 1057–1077.

Thomas, D.G.: Heat and Momentum Transport Characteristics of Non–Newtonian Aqueous Thorium Oxide Suspensions,; *AIChE J.* (1960) 6, 631–39.

Thomas, D.G.: "Transport Characteristics of Suspensions: Part VIII. A Note on the Viscosity of Newtonian Suspensions on Uniform Spherical Particles," *J. Colloid Sci.* (1965) 20, 267–77.

Hannah, R.R., Harrington, L.J., and Lance, L.C.: "Real Time Calculation of Accurate Bottomhole Fracturing Pressure From Surface Measurements with Measured Pressure as a Base," paper SPE 12062 presented at the 1983 SPE annual Technical Conference and Exhibition, San Francisco, Oct. 5–8.

Gidley, J.L., Holditch, S.A., Nierode, D.E., and Veatch, R.W. Jr.,: "Recent Advances in Hydraulic Fracturing", *Ch. 9 "Fracturing Fluid Behavior"*, SPE Monograph, vol. 12. Henry L. Doherty Series, pp 190.

Nicodemo, L., Nicolais, L. and Landel, R.F.: "Shear Rate Dependent Viscosity of Suspensions in Newtonian and Non–Newtonian Liquids," *Chem. Eng. Sci.* (1974) 29, 729–35.

Jeffrey, D.J. and Acrivos, A.: "The Rheological Properties of Suspensions of Rigid Particles," *AIChE J.* (May 1976) 22, No. 3, 417–32.

Nolte, K.G.: "Fluid Flow Considerations in Hydraulic Fracturing," SPE 18537 presented at the Society of Petroleum Engineers Eastern Meeting in Charleston, W.V, Nov. 1–4, 1988.

Latto, B, Round, G.G., and Anzenavs, R.; "Drag Coefficients and Pressure Drop for Hydrodynamically Suspended Spheres in a vertical tube with and without Polymer Addition," *Cdn. J. Chem. Eng.* (Oct. 1973) 51, 536–41.

* cited by examiner

METHOD OF PREDICTING FRICTION PRESSURE DROP OF PROPPANT-LADEN SLURRIES USING SURFACE PRESSURE DATA

REFERENCE TO RELATED PROVISIONAL APPLICATION

This application claims the benefit of provisional application Ser. No. 60/336,349 filed Oct. 24, 2001.

TECHNICAL FIELD OF THE INVENTION

The present invention relates to the art of fracturing subterranean formations and more particularly to a method for determining frictional pressure drop of proppant-laden slurries using surface pressure data. The invention used in the process of designing and analyzing stimulation treatments of subterranean formations such as fracture treatments.

INTRODUCTION TO THE TECHNOLOGY

A typical hydraulic fracturing treatment involves pumping of fracturing fluid to initiate and propagate a down-hole fracture, followed by varying concentrations of proppant in order to keep the fracture propped open after the pumping stops. This results in creation of a conductive pathway that enables the hydrocarbons to move with a relative ease, ultimately resulting in an increased production. Hydraulic fracturing treatments are generally designed in advance by inputting the best possible information pertaining to fracturing fluids, formation rock properties, etc. in any of the several fracturing simulators used by well services companies.

During the actual execution of the job however, the fracture geometry can be more appropriately judged by observing the net pressure trends. Net pressure trends are more critical in the proppant stages because any incorrect interpretation may lead to an early termination of the treatment and hence the designed objectives may not be achieved. On other hand, extending the job when a screen out is imminent may lead to a proppant pack in the tubular and may incur additional expenditure. Net pressure is defined as the pressure in excess of closure pressure, which, in turn, is the minimum pressure, required for the fracture to remain open. Net pressure is usually calculated from bottom hole pressures.

Bottom hole pressures (BHP) may be measured using downhole pressure gauges, live annulus, dead strings, or memory gauges. However, in most of the treatments around the world, such devices are not available due to economic feasibility or other restrictions. Therefore, in practice, the bottom hole pressure is ascertained by field personnel, based on the pressures recorded at the surface. This computation requires knowledge of fluid frictional pressures. Though several correlations and pressure charts are available and capable of predicting accurate frictional pressures, these charts typically don't include proppant-laden fluids and therefore, are not completely accurate for hydraulic fracturing fluids.

There is thus a need for new procedures for better determination of the slurry frictional pressures based on the recorded surface pressures in the proppant stages.

SUMMARY OF THE INVENTION

The invention pertains to a unique procedure of analyzing surface pressures to obtain a correlation capable of predicting pressure drops in proppant laden slurry. The procedure is based on close monitoring of surface pressure to define a "net pressure rate" which defines an increase or decrease of net pressure while the job is being pumped, and then relates it with the pressure changes observed with the onset of proppant stages of varying concentrations. The process results in defining "Frictional Pressure Multipliers" corresponding to different proppant concentrations. These frictional pressure multipliers are then used to develop correlations to predict pressure drop during proppant stages.

PRIOR ART

In comparison to the pad fluid, proppant-laden slurries are more complex to model because of the existence of two-phase flow consisting of base gel and solid proppant. On a typical hydraulic fracturing job, surface pressure show a decreasing trend with the introduction of proppant stages. This reduction in surface pressure is primarily due to the increment in fluid density caused by the addition of solids in the fluid. A closer look however, reveals that the loss of pressure is not entirely due to an increase in hydrostatic pressure. This observed difference could be attributed to the additional friction pressure introduced because of the proppants. Major factors that contribute to increased friction pressures are proppant concentration, tubular size, flow rate, and slurry viscosity. For simplicity the proppant friction has been traditionally quantified as an increment to the base gel friction, so it can be included in existing models. Lack of proper modeling and theoretical understanding of the proppant-laden slurry, has however contributed to the limited data available in this field of investigation.

Historically, the researchers have found it relatively easy to generate theories for predicting friction pressure losses for Newtonian fluids in comparison to the viscoelastic non-Newtonian fluids. The same can be extended to proppant laden slurries, where there are several expressions for predicting friction pressures for slurries composed of Newtonian fluids and solid particles. However, there are not enough theories for how particles affect the friction pressure of highly non-Newtonian fluids.

Literature review clearly reveals that the researchers in past have traditionally used two distinct methods to define the friction pressure drop of proppant laden slurries. A first method attempts to define the slurry frictional pressures by using friction multipliers that are a function of relative viscosity of slurry and base gel. The second method attempts to define the total pressure drop as a sum of base gel friction and additional pressure drop due to proppant.

Einstein in 1905, based on his work on Newtonian quiescent solutions, was the first to propose relative viscosity of dilute suspension as a function of particle volume fraction (Einstein, A.: *Ann. Physik* (1905) 17, 459; (1906) 19, 271–89). The relation is give as $$\frac{\mu_{sus}}{\mu} = 1 + \alpha\phi \tag{1}$$

where $\mu_{sus}$, $\mu$, $\phi$, and $\alpha$ are the viscosity of dilute suspensions, viscosity of suspending medium, volume fraction solids, and a constant, respectively. Later, this approach of defining slurry viscosity as a function of particle volume fraction was used by several researchers trying to model slurry friction pressure as a function of slurry viscosity.

Hannah, Harrington and Lance proposed that total slurry friction was the product of base-gel friction and a multiplier to account for the proppant (See Hannah, R. R., Harrington, L. J., and Lance, L. C.: "*Real Time Calculation of Accurate Bottomhole Fracturing Pressure From Surface Measurements with Measured Pressure as a Base*" paper SPE 12062 presented at the 1983 SPE annual Technical Conference and Exhibition, San Francisco, October 5–8.). Based on their approach, $$f_s = f_b \times CF \tag{2}$$

where, $f_s$ is the slurry friction factor, $f_b$ is the base-gel friction factor, and CF is the proppant friction multiplier. The authors were more focused on obtaining the friction pressure multipliers, as the base-gel friction information was obtained using the standard pressure charts available from service companies that pump the fluids. During the process they assumed a turbulent friction factor versus Reynolds number equation with a slope of −0.2, and obtained the following correlation for proppant multiplier $$CF = \mu_r^{0.2} \rho_r^{0.8} \tag{3}$$

where, $\rho_r$ is the relative slurry density. In: "*Transport Characteristics of Suspensions: Part VIII. A Note on the Viscosity of Newtonian Suspensions of Uniform Spherical Particles*" J. Colloid Sci. (1965) 20, 267–77, Thomas, D. G. defined a relative slurry visocosity $\mu_r$ as the ratio of slurry viscosity to the viscosity of suspending medium, $\mu$. Following equation was proposed to define, $\mu_r$, $$\frac{\mu_s}{\mu} = \mu_r = 1 + 2.5\phi + 10.05\phi^2 + 0.00273e^{16.6\phi} \tag{4}$$

where, $\mu_s$ is the slurry viscosity, and $\phi$ is the particle volume fraction. This suggests that the relative viscosity, $\mu_r$, is a function of proppant volume fraction with $\rho_r$ being the ratio of proppant-laden and proppant free fluid densities. It is implied that overall, the friction multiplier is a function of proppant density, proppant concentration, and fluid density only and appears to have no relationship with fluid rheology, flow rate, proppant size, or tubular diameter. The general application of such a correction factor would therefore be suspicious. However, CF has been reported to predict the increase in friction pressure with proppant addition accurately. These tests were carried out with the slurry flowing down the annulus where the tool joint collars may have significant effect on flow profile due to obstruction of flow.

In "*Shear Rate Dependent Viscosity of Suspensions in Newtonian and Non-Newtonian Liquids*" Chem. Eng. Sci. (1974) 29, 729–35, Nicodemo, L., Nicolais, L. and Landel, R. F. proposed an expression, popularly known as Landel's correlation, to fit the limits of both infinite and high solids concentration. The relationship is given by $$\mu_r = \left(1 - \frac{\phi}{\phi_m}\right)^{-2.5} \tag{5}$$

where $\phi_m$ is the maximum obtainable volume concentration of particles where the slurry can still be sheared. For cubical packing, $\phi_m$ is given as 0.48 and for loosely packed sand it is around 0.62. Its value in literature is generally found to be between 0.56 and 0.66. Although some of the suspensions used in the study exhibited non-Newtonian behavior at the lowest shear rates, they all behaved as if Newtonian at the high shear rates where the viscosity was calculated.

None of these expressions, or variant of them proposed by different authors, account for observed non-Newtonian effects due to addition of proppants. It has been shown that even for Newtonian fluids, the slurry viscosities are a function of flow shear rate. The existence of shear effects for simple Newtonian fluids suggests there might be considerably greater shear effects for non-Newtonian fracturing fluids. In "*Fluid Flow Considerations in Hydraulic Fracturing*" SPE 18537 presented at the Society of Petroleum Engineers Eastern Meeting in Charleston, W.Va., Nov. 1–4, 1988, K. G. Nolte accounts for the effects of shear effects on viscosity in his paper on fluid flow considerations during hydraulic fracturing. He proposes that for an externally imposed shear rate, $\gamma_o$, the presence of particles obstruct the shear flow and locally increase the shear rate by a multiplier say m, resulting in a final shear rate of $m\gamma_o$. As a result of increase in shear rate, shear stress also increases, thus resulting in increase of apparent viscosity. Apparent viscosity multiplier, $m_\mu$, defines the ratio of shear stresses in the presence of particles to the shear stresses in absence of particles as follows $$m_\mu = \frac{m \times \mu_a(m\gamma_o)}{\mu_a(\gamma_o)} \tag{6}$$

where, $\mu_a(x)$ denotes the apparent viscosity of the fluid system at the shear rate x. For Newtonian fluids, apparent viscosity is independent of shear rate and hence apparent viscosity multiplier is same as shear rate multiplier. Thus, $$m_{\mu N} = m \tag{7}$$

where, $m_{\mu N}$ is Newtonian apparent viscosity multiplier. He further proposed that Newtonian shear rate multiplier m can be determined by the Landel correlation shown by Eq. (5) by using $m = m_{\mu N} = \mu_r$, or the following Frankel Archivos correlation disclosed in Govier, G. W. and Aziz, K.: *The Flow of Complex Mixtures in Pipes* van Nostrand Rheinhold Co., New York City, (1972), pp 98:.

$$m_{\mu N} = \left(1 + 1.125\frac{(\phi/\phi_m)^{1/3}}{(1 - \phi/\phi_m)^{1/3}}\right) \tag{8}$$

in standard notations. For Power law fluids, with exponent, n as the flow behavior index, it can be easily shown that $$m_\mu = \frac{m}{m^{1-n}} = m^n \tag{9}$$

Combining the fact that $m = m_{\mu N} = \mu_r$ and Eq. (9), the Landel correlation of Eq. (5) can now be given as $$m_\mu = \left(1 - \frac{\phi}{\phi_m}\right)^{-2.5n} \tag{10}$$

Shear rate multiplier can now be modified to accommodate the effect of Power Law fluids, with yield value of $\tau_y$ as follows, $$m_\mu = m\frac{\tau_y + K(m\gamma)^n}{m\gamma}\frac{\gamma}{\tau_y + K\gamma^n} = \frac{1 + rm^n}{1 + r} \tag{11}$$

where, $r = K\gamma^n/\tau_y$. As per the observations made, the correlations predicted the viscosity with reasonable accuracy. However, the scope of the Nolte's study was not extended to predicting the frictional pressure losses in slurries.

In another study by Keck, Nehmer, and Strumolo, "*A New Method for Predicting Friction Pressures and Rheology for*

*Proppant-laden Fracturing Fluids*" SPE 19771 presented at the 64$^{th}$ Annual Technical Conference and Exhibition of the Society of Petroleum Engineers held in San Antonio, Tex., Oct. 8–11, 1989, a new correlation predicting relative slurry viscosity was presented $$\mu_r = \left\{1 + \left[0.75\left(e^{1.5n'} - 1\right)\exp^{-(1-n')\dot{\gamma}/1000}\right]\frac{1.25\phi}{1 - 1.5\phi}\right\}^2 \quad (12)$$

For this study, the value of $\phi_m$ was assumed to be 0.66. A more meaningful friction multiplier could be obtained by using a derivation similar to that given by Hannah et al., but using a maximum drag reduction asymptote slope of −0.55 on a plot of friction factor versus Reynolds number. Resultant equation was given as $$M = \mu_r^{0.55}\rho_r^{0.45} \quad (13)$$

where M is the friction multiplier.

In "*Experiments on the Suspension of Spheres in Inclined Tubes-I Suspension by Water in turbulent Flow*" *Chem. Eng. Sci.* (1967) 22, 1133–45. 1967, Round and Kruyer proposed that the pressure drop through vertical pipe for fluids containing a sphere can be separated into three components, the pressure drop resulting from liquid flowing in the tube without the sphere present, the pressure drop caused by the drag force on the sphere, and the pressure drop owing to flow line disturbance because of the sphere. The last two components were then combined, and measured with sphere in vertical tube flowing with water.

In "*Drag Coefficients and Pressure Drop for Hydrodynamically Suspended Spheres in a vertical tube with and without Polymer Addition*" *Cdn. J. Chem. Eng.* October 1973) 51, 536–41, Latto, B, Round, G. G., and Anzenavs, R. extended the work by adding polymer to the water, showing that with addition of polymer, the values of pressure drop observed were less than the ones determined by Round and Kruyer. Based on his experiments, the following correlation was proposed for single spheres hydro-dynamically suspended in polymer with a concentration range of 0 to 50 ppm by weight $$\Delta p_p = 0.633\left(\frac{d_p}{d}\right)^{2.94}[(\rho_s - \rho_f)d\sin\theta] \quad (14)$$

where, $\Delta p_p$ is the sum of friction pressures mentioned above, $d_p$ is the particle diameter, d is the tubular diameter, $\rho_s$ is the density of slurry and θ is the tube inclination.

In "*Friction Pressures of Proppant-Laden Hydraulic Fracturing Fluids*" SPE Production Engineering November 1986) 437–45, Shah and Lee presented a detailed theory and empirical master curve for predicting the effect of proppant that is based on extending the work of Molerus and Wellmann on horizontal pipes. Froude number, which is defined as the ratio of inertial force to gravitational force, was used extensively in their analysis. According to this study, the pressure drop of proppant-laden fluids $\Delta p_t$, can be expressed as the sum of pressure drop of clean fluid, $\Delta p_{ft}$, and an additional pressure drop, $\Delta p_p$, due to proppant. Hence, $$\Delta p_t = \Delta p_{ft} + \Delta p_p \quad (15)$$

The study basically revolves around four dimensionless parameters namely $\Delta p_D$, the dimensionless pressure drop, $\bar{v}/v$, the dimensionless slip, $N_{Frp}$, the particle Froude number, and $N_{Fr}^*$, the terminal Froude number. The study proposes that the dimensionless slip, $\bar{v}/v$, is a unique function of the dimensionless numbers $N_{Frp}$ and $N_{Fr}^*$. To calculate $N_{Fr}^*$, the settling velocity of proppant in the fluid needs to be calculated first. The correlations for this has been published in another study carried out by Shah in "*Proppant Settling Correlations for Non-Newtonian Fluids under Static and Dynamic Conditions*" Trans., AIME, 273, Part 2 (1982) 164–70. In summary, the increased friction pressure caused by proppant was obtained with a modified Froude number analysis, and led to a universal empirical curve for friction pressure in vertical piping systems.

Lord, D. L. and McGowan, J. M. in "*Real-Time Treating Pressure Analysis Aided by New Correlation*" SPE 15367 presented at the 61$^{st}$ Annual Technical Conference and Exhibition of the SPE held in New Orleans, La., Oct. 5–8, 1986 proposed a laboratory correlation for HPG fluids that could be readily used for field applications. This correlation relates tubing diameter, flow rate and gel/proppant concentration to predict tubular friction pressure for polymer-laden fluids and also proppant-laden slurries. Eq. (14) shows the relation $$\ln(1/\sigma) = 2.38 - 8.024/\bar{v} - 0.2365G/\bar{v} - 0.1639\ln G - 0.028Pe^{\frac{1}{G}} \quad (16)$$

where G is the gel concentration in lbm/Mgal, $\bar{v}$ is the average tubular velocity ft/sec, P is the proppant concentration in lbm/gal, and σ is the drag ratio defined as $$\sigma = \Delta p_{G,P}/\Delta p_o \quad (17)$$

where, $\Delta p_o$ is the friction pressure of the Newtonian water solvent, and $\Delta p_{G,P}$ is the frictional predicted frictional pressure drop of fluid with or without slurry. $\Delta p_o$ given in oilfield units by $$\Delta p_o = 0.40429d^{-4.8}q^{1.8}L \quad (18)$$

where, d is the tubular diameter in inches, L is the length of the tubular in feet, and q is the flow rate in bbl/min.

DETAILED DESCRIPTION

The above and further objects, features and advantages of the present invention will be better understood by reference to the appended detailed description and to the drawings wherein:

FIG. 1 is a typical plot of the pressure measured at the surface during hydraulic treatment. Read the treating pressure from left y-axis and slurry rate and proppant concentration from the right y-axis. Note the points denoted for different stages in the job. Proppant stabilized pressure must be noted for every stage along with the end of the stage stabilized pressure.

Figure 9:
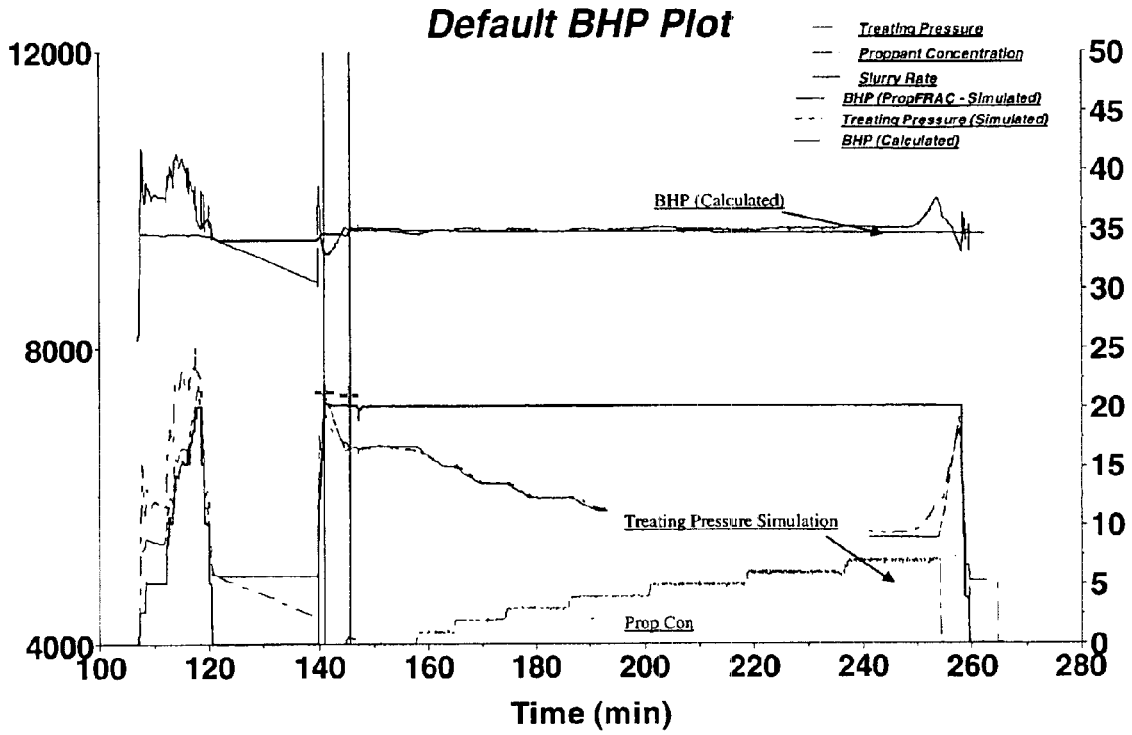

FIG. 9 is a plot generated by FracCADE™ and shows the results of pressure-match using a hypothetical error. Pressures are in psi and should be read from left Y-axis whereas slurry rate and proppant concentration shown in bbl/min and in ppa respectively, should be read from right Y-axis The approach adopted for the current study is a combination of the methods described in above sections. Friction pressure drops are calculated for individual proppant stages and transformed into friction multipliers by relating them with base gel friction pressure. As stated in literature review, here the total friction is considered as the sum of base gel and proppant friction. Later on, plots of friction pressure multipliers versus ratio of solids volume fraction are generated to define a proppant friction exponent that is used to describe the proppant friction pressure trends.

A survey of around 300 hydraulic fracture jobs containing recorded surface pressure data was carried out. The major criterion used for job selection was majority of proppant stages had to be one or more tubular volumes so that the surface pressure responses could be adequately observed. Apart from this, it was also important to have a record of instantaneous shut in pressure (ISIP) for each job, to ascertain base-gel friction accurately. Around 168 hydraulic fracturing jobs that met the criterion were selected for the study.

The base fluid was composed of different gel concentrations of Carboxymethylhydroxypropyl guar (CMHPG), cross-linked with zirconate based crosslinker and the proppant size for all the jobs was 20/40 mesh. Varieties of proppants with differing specific gravities were used for the study. Varieties of proppants with differing specific gravities were used. Though proppant concentrations as high as 10 ppa were observed for some cases, the majority of data was restricted to 8 ppa.

Figure 1:
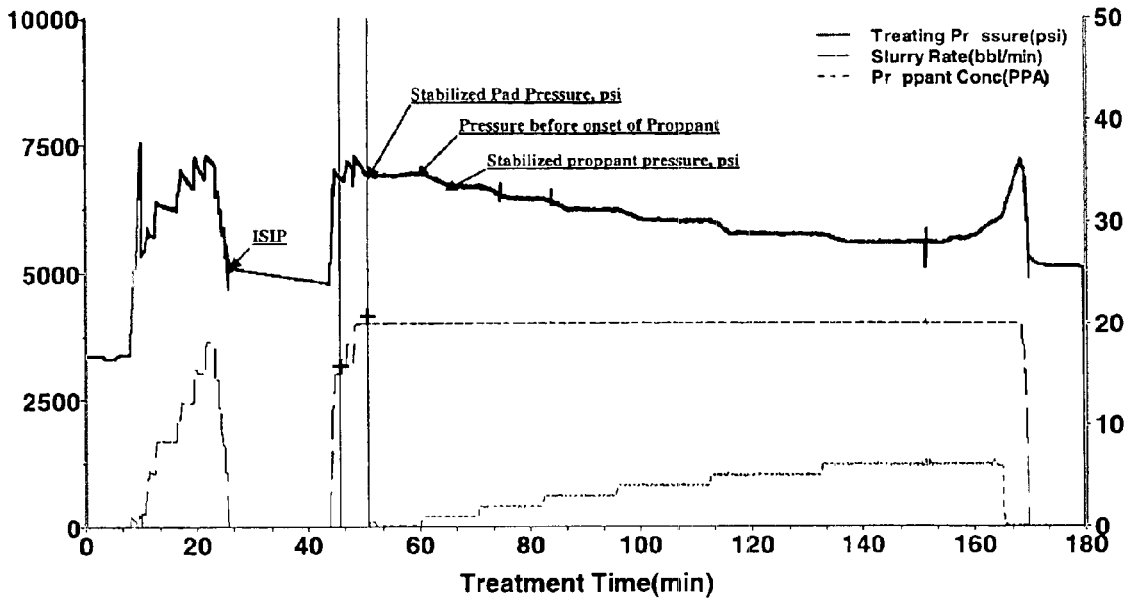

The technique used in computing friction pressures was similar to the one used in generating friction pressure correlation for CMHPG fluids (Pandey, V. J.: "*Friction Pressure Correlation for Guar-Based Hydraulic Fracturing Fluids*" SPE 71074 presented at the SPE Rocky Mountain Petroleum Technology Conference held in Keystone, Colo., May 21–23, 2001). In this approach it was extended to the proppant stages as well. Friction pressure drops for the fracturing fluids without proppant can be computed by obtaining the value of ISIP by shutting down the pumps before beginning the pad stage or somewhere in the early portion of the pad if it is sufficiently large. Before the shut down the well must be fully displaced with a fluid of known density for accuracy in hydrostatic pressure calculations. Friction pressure can be computed using the following equation $$\Delta p_f = p_s - p_{bh} + \Delta p_H \tag{19}$$

where, $\Delta p_f$ is the tubular friction pressure, $p_{bh}$ is the bottom hole pressure, $p_s$ is the surface pressure, and $\Delta p_H$ is the hydrostatic pressure. Surface pressure is noted at the point when the pad fluid just makes its entry on the perforations and the pressure appears to level out temporarily. It is assumed that at this point net pressure is low and has no significant effect on the calculation. Perforation frictions are neglected because several data points are usually available for one tubular diameter and flow rate enabling the data analyst to take the mean. FIG. 1 shows a typical surface pressure plot generated during a hydraulic fracturing job. The points where the pressure-data points should be picked are clearly shown in the plot. For an ISIP based pressure data, the frictional pressure gradient can be computed using the following simple relationship $$\frac{\Delta p_f}{L} = \frac{p_s - ISIP}{\text{Depth}} \tag{20}$$

FIG. 1 also shows the recorded surface pressure data for proppant stages from one of the jobs that were selected for the purpose of study. Note the decrease in the surface pressure as subsequent proppant stages are introduced. The loss of pressure is attributed to the increase in hydrostatic pressure. However, a detailed analysis shows that the surface treating pressures are higher than expected if the drop had been purely due to the increased fluid density.

Friction pressure losses corresponding to individual proppant stages can be determined by using measured surface pressure before starting the proppant stage, pressure as the stage hits the formation change in hydrostatic pressure, and the net pressure rate. The jobs selected for the study followed a "staircase" mode for stepping up the proppant concentration and the stages were sufficiently large to monitor the surface pressure as the new proppant concentration made its way into the fracture.

Figure 2:
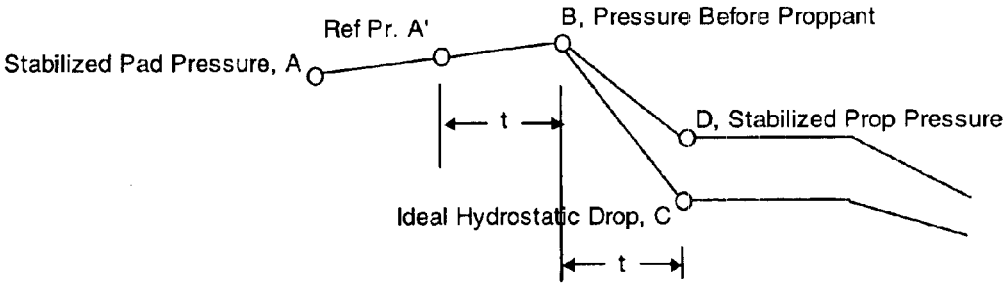
FIG. 2 shows details of proppant pressure drop measuring procedure according to the invention. The increase of the surface pressure in the preceding stage is taken account of in the subsequent stages with an assumption that pressure would continue to change at the same rate for the displacement of tubing volume in time.

FIG. 2 shows the details of an idealized pressure response. Surface pressure in the pad increases from point A to B where point A corresponds to the stabilized pad pressure that was used to compute the frictional pressure drop of the fluid without proppant, using Eq. (20). ISIP used for computing frictional pressure of pad is also shown in the plot. With the onset of proppant stage however, the surface pressure declines and levels out at point D. If the pressure losses were purely due to the increase of hydrostatic pressure, the surface pressures would have theoretically been at point C, if a negative net pressure does not exist at that point. This indicated that the numerical difference between point D and C is the additional frictional drop imparted to the fluid with the addition of the proppant. However, at this point it must also be realized that before the proppant was introduced in the fluid, surface pressures showed an increasing trend. The precise reason for the increase (or decrease) of surface pressures, which may be due to changes in fluid rheology, friction generated as the fluid propagates in the fracture, excessive near well bore restrictions, or simply an extension of the fracture, cannot be determined without the presence of live BHP or BHP gauges. However, it is important that such effects be accounted for to arrive at meaningful results. Further, for how long the pressures would have continued to increase cannot be predicted but an assumption is made that they would continue to increase at the same rate (psi/min) for the time required to displace the entire tubing volume with proppant. Thus the difference B−A' is now considered to be the gain in net pressure in a particular stage and is deducted from the computed frictional pressure drop. Following equation summarizes the procedure.

$$\Delta p_p = (p_{HYDs} - p_{HYDf}) - (p_B - p_D) - p_{net} \tag{21}$$

where, $p_B$ and $p_D$ are the surface pressures corresponding to points B and D shown in FIG. 2, and $P_{net}$ is the net pressure described above. In some cases, as was observed during the study, there is apparently no gain or loss in the surface pressures during pad or proppant stages. In any event, the net pressure gain or loss is recorded for subsequent proppant stages. Total net pressure deducted while calculating pressure drop of a particular proppant stage, is the sum of net pressure build up till that stage. This is to make sure that the additional surface pressure gained as the treatment progresses to the point of interest is effectively removed. For example net pressures deducted in pressure drop calculation of 6 ppa stage in a pad-2-4-6-8 scheme would be the sum total of net pressures till the 4 ppa stage. It must be borne in mind that net pressure values can be positive or negative depending on the observed pressure gain or loss. Once the frictional pressure drops for individual stages are obtained, a friction multiplier, $M_f$ can be generated as follows $$M_f = \frac{\Delta p_f + \Delta p_p}{\Delta p_f} \tag{22}$$

Landel's correlation shown in Eq. (5) proposes to define the relative slurry viscosity in terms of proppant volume fraction by fixing the value of the exponent to −2.5. In this study plots of friction multiplier, $M_f$ defined in Eq. (22), versus $1-\{\phi/\phi_m\}$ were generated and it was observed that the value of exponent changed considerably for different scenarios. In terms of frictional multiplier, a higher absolute value of e would reflect a higher value of frictional pressures based on the following equation $$M_f = \left[1 - \frac{\phi}{\phi_m}\right]^{-e} \tag{23}$$

Value of $\phi_m$ used in this study was 0.56. Though most of correlations, depict the relationship between proppant volume fraction $\phi$ and relative slurry viscosity $\mu_r$, this study emphasized on finding the values of exponent e for various cases and exploring its dependence on various other parameters like specific gravity, tubular internal diameter, and average flow velocity.

Proppant volume fraction $\phi$ can be calculated using the following relation $$\phi = \frac{ppa}{(8.33 \times S.G._p) + ppa} \tag{24}$$

where, ppa is proppant concentration in lbm/gal. Friction pressure data were sorted on the basis of tubular diameter, gel concentration and proppant specific gravity. Gel concentrations recorded for the study were 30, 35, 40, and 45 lbm/Mgal flowing through tubular inner diameters of 2.441, 2.99, 3.92 and 4.0 inches, at several rates. Proppant specific gravity varied from 2.54 and 2.57 for resin-coated sands, 2.65 for Ottawa sand, 2.72 for Econoprop, and 3.25 for Caroboprop. Slurry hydrostatic pressures were computed using the surface proppant concentration noted recorded by the densitometers at the blender.

Figure 3:
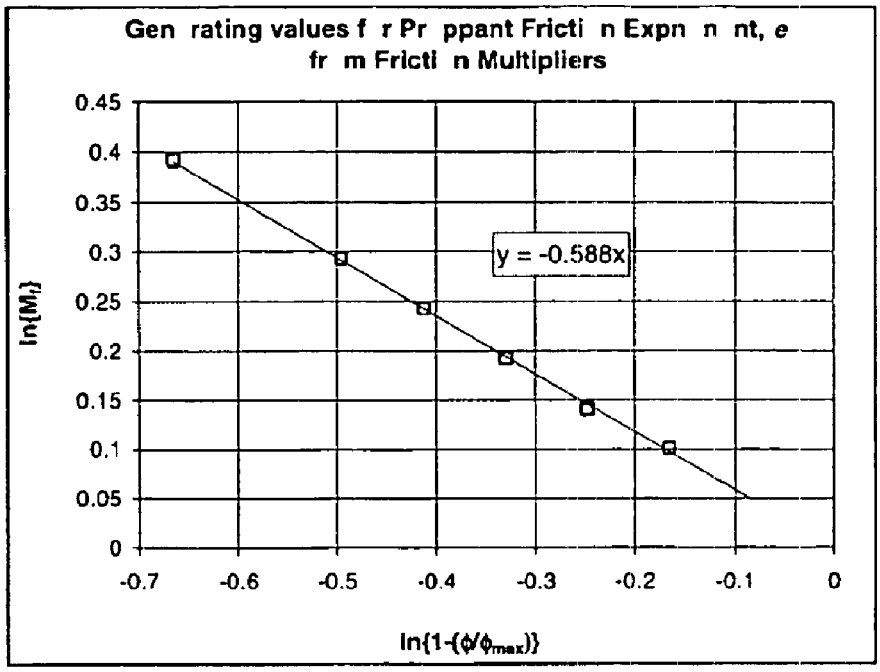
FIG. 3 is a plot showing the procedure of generating e values by using the friction pressure multipliers.

Several plots of In {Mf} versus In$[1-\{\phi/\phi_m\}]$ were generated. e was obtained as the slope of the line by setting the intercept to the origin of the plot at zero. FIG. 3 shows a typical plot used for generating the e values. The flow rate was 20 bbl/min of 35 lbm/Mgal in a tubular internal diameter of 2.99 inches. Proppant was Econoprop with a specific gravity of 2.72.

Figure 4:
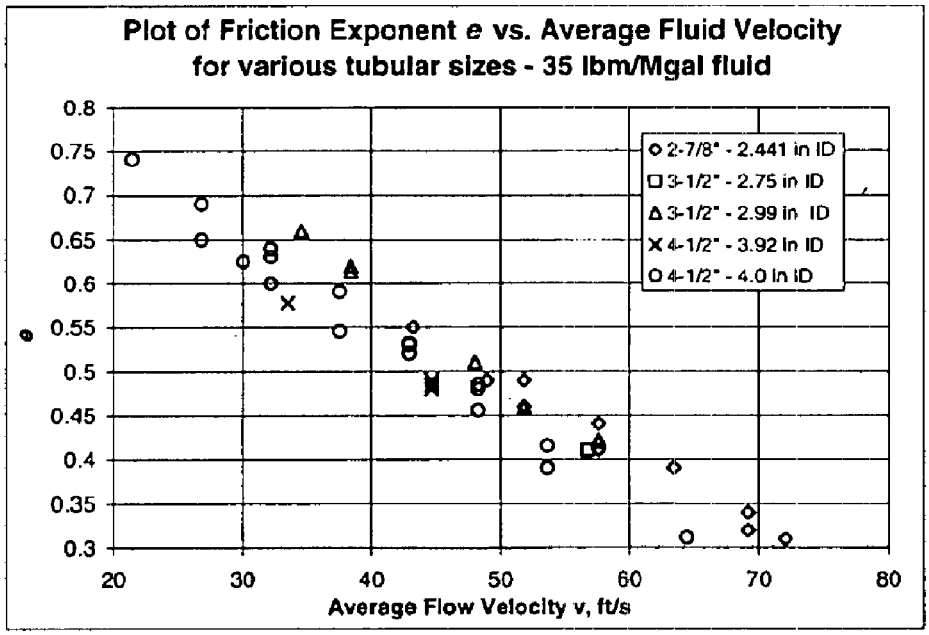
FIG. 4 shows the friction exponent e is plotted against average flow velocity for slurries of various proppant specific gravities ranging from 2.54 to 2.72 flowing in tubular of varying internal diameters.
Figure 5:
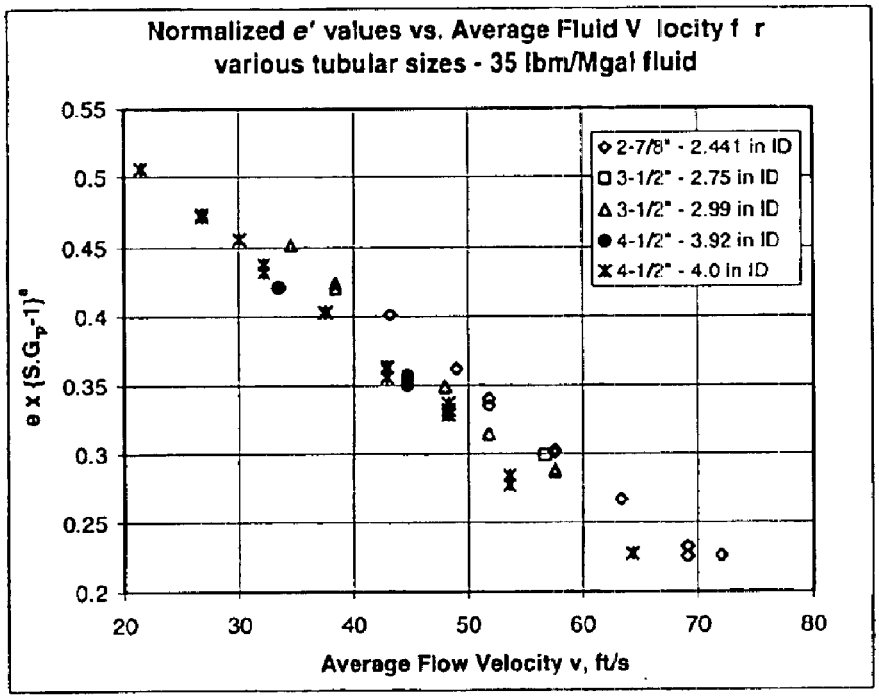
FIG. 5 shows the values of the friction exponent e after including the effect of proppant specific gravities.

FIG. 4 depicts a plot of friction pressure exponent e vs. the average flow velocity $\bar{v}$ in ft/s for various proppant types in a base gel of 35 lbm/Mgal. Higher proppant specific gravity exhibited higher e values for the same flow velocity in one particular tubular size. This effect was noted for almost all data sets of same flow velocity but different specific gravities. On an average with nearly 6.5% increase in proppant specific gravity, the exponent increased by nearly 7.5%. Effect of proppant density was taken into consideration by plotting e' vs average flow velocity $\bar{v}$, where e' is given by $$e' = e \times \{S.G._p - S.G._w\}^a \tag{25}$$

where $S.G_p$ and $S.G._W$ are the specific gravities of proppant and water respectively, and a is the coefficient to be determined by plotting the data. Specific gravity of water is unity. FIG. 5 shows the plot of normalized e' values for the data in the plot of FIG. 4. The reduction in scatter of the data points is evident. It can also be noted that the trend for various tubular diameters is linear and the trend lines would be almost parallel to one another. Further, for the same flow rate, the normalized e values are lower for higher tubular diameter.

Figure 6:
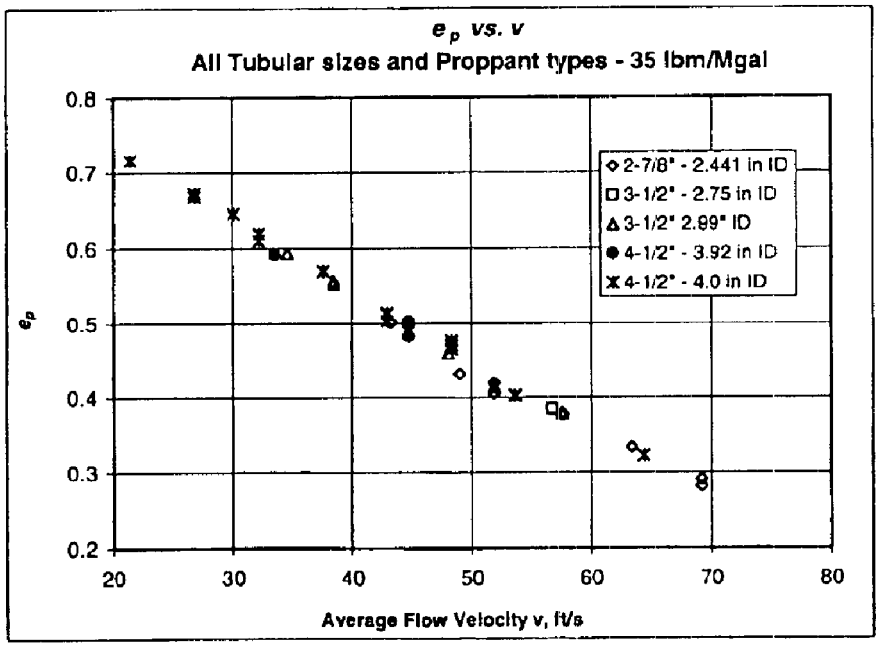
FIG. 6 shows the data of FIG. 5, "collapsed" in one line by introducing the effect of diameter in the plotting.

After the effect of proppant specific gravities are taken into consideration, the data pertaining to one tubular diameter is represented by a linear trend which shows a decrease in e' with the increase in average flow velocity. This can be seen in FIG. 5. Though the lines appear to exhibit a similar slope, it is apparent from the plot that the separation is some function of tubular internal diameter through which the slurry was flowing. Using several runs of trial and error procedure the data was successfully collapsed by plotting modified form of e', given as $e_p$ and explained by following relation $$e_p = e \times \{S.G._p - S.G._w\}^a \times d^z \tag{26}$$

where d is the tubular internal diameter in inches, and $\bar{v}$ is the average flow velocity in ft/s. z can be determined by generating the mentioned plots. FIG. 6 shows the plot of $e_p$ generated for all the data available for 35-lbm/Mgal fluid. The data set appears to significantly collapse into a single linear trend.

Figure 7:
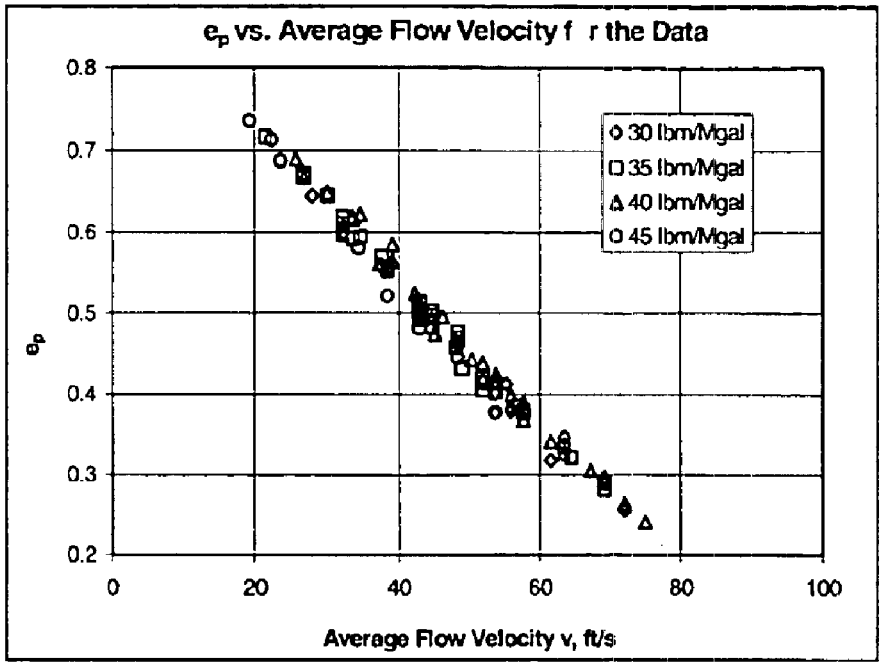
FIG. 7 shows the values of a modified form $e_p$ of the friction exponent e plotted against average flow velocity for different gel types.

Proppant friction exponents corresponding to other gel concentrations were plotted in a similar manner and linear trend showing nearly identical slopes and intercepts were observed. Fluid base gel viscosity does not appear to significantly affect the plots of $e_p$ vs. $\bar{v}$, since the curves representing all the fluid types under study, i.e. 30, 35, 40, and 45 lbm/Mgal, overlap on one another, when plotted on one plot. This is shown in FIG. 7. A high correlation coefficient (0.9847) was observed. Correlation obtained from the plot is given as $$e_p = 0.9035 - 0.0091 \times \bar{v} \tag{27}$$

Based on Eq. (26) and Eq. (27), e can be calculated as $$e = (0.9035 - 0.0091 \times \bar{v}) \times \{S.G._p - S.G._w\}^a \times d^z \tag{28}$$

where, d is the tubular diameter in inches, and $\bar{v}$ is the average flow velocity in ft/s. Friction multiplier $M_f$ can now be obtained from e using the relation shown in Eq (28) and the pressure drop due to addition of proppant can be predicted by using the following relation $$\frac{\Delta p_{sl}}{L} = M_f \times \frac{\Delta p_{gel}}{L} \tag{29}$$

where, $\Delta p_{sl}$ is the frictional pressure drop in the slurry and $\Delta p_{gel}$ is the frictional pressure drop of the base gel.

Figure 8:
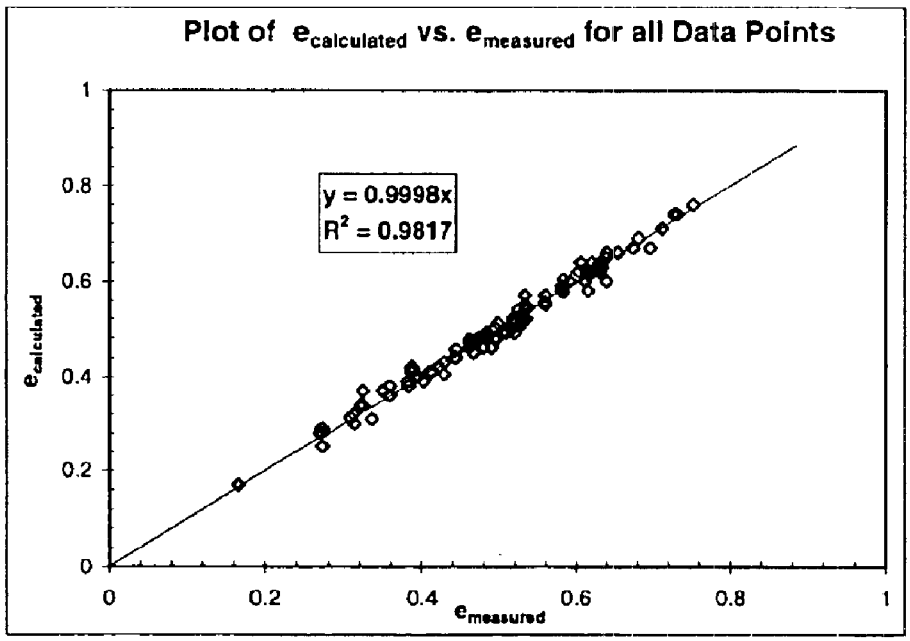
FIG. 8 shows the plot of calculated vs. measured values of proppant friction exponent.

FIG. 8 shows the plot of e values that were obtained by using the correlation vs. the e values that were used in the development of correlation. Note that the slope of the distribution is around unity. Correlation Coefficient $R^2$ is around 0.9817 indicating that a deviation from the measured data may still exist. The deviation of calculated values of proppant friction coefficient with measured values however does not have very significant effect on the friction pressure drop when a comparison is carried out. Due to the exponent nature of e values, the variation often translates to difference in pressure drops at higher proppant stages. However, even this is not very significant. Consider for example, the plot shown in FIG. 9 showing the measured and the matched surface pressure responses. The job was carried with 35 lbm/Mgal fluid down 2.99 inch tubular internal diameter at 20 bbl/min. For proppant specific gravity of 2.72 (Econoprop) and an average velocity of 38.41 ft/s, this amounts to an e value of around 0.616. This compares very well with 0.62, which was the actual e values used for a good pressure match, indicating that the predicted deviation is only 0.504%. For the purpose of demonstration, a hypothetical error of around 9% is introduced and the plot is redrawn with an e value of 0.56. The results are shown in the plot of FIG. 9. The simulated surface pressures in the plot do not seem to differ much from the measured value, and the simulated BHP matches the calculated BHP (using measured surface pressure and input fluid/proppant friction) for most of the job. Base gel fluid friction values were based on a correlation previously developed for CMHPG fluids and checked against the observed ISIP and pad pressure. Note that both these points are matched adequately in the plot.

Plot of FIG. 4 sheds some light on the diameter dependence of proppant friction exponent. It clearly shows that for the same average velocities and proppant specific gravities, smaller diameters tend to have larger values of proppant friction exponent. It has been shown through experiments conducted for borate cross linker based HPG fluids in vertical tubulars that after a certain critical flow velocity, the proppant in the slurry has a tendency to migrate towards the center of the pipe. Further, based on several jobs, it can be said that the event of proppant landing on the perforations is often marked by leveling out of surface pressures and the landing is consistent with the calculated time based on displacement volume and slurry rate. This would mean that the velocity profile in turbulent regime is mostly flat as there has been little indication that the proppant in the core would land ahead of the calculated time. Thus with the increase in proppant concentration at the surface, the diameter of internal core would increase to a point where it may lead to aberration of pipe-wall flow and contribute to higher friction pressures. These effects will be more pronounced for lower diameter tubular since relatively lower proppant concentrations would cause a rapid increase in the supposed proppant core diameter leading to an earlier proppant to wall interaction. This would eventually lead to a steeper increase in friction multipliers for lower diameter tubulars compared to larger diameters, for the same proppant volume fraction. Based on the definition of proppant exponent, this means a larger e value.

It must be borne in mind that use of correlation such as this may be restricted to the range of average velocities that have been used to define it. The correlation was generated using average flow velocities in the range of 20 to 80 ft/s. Most of the hydraulic fracturing treatments pumped these days should fall in this range. Furthermore the correlation may be valid mainly for proppant sizes closer to 20–40 mesh where the average grain size is around 0.026 inch. The effect of change in the friction pressure with the change in proppant size is currently not studied. The proppant friction pressure data used for developing these correlations was largely from vertical wells, and it remains to be seen if it can be extended to deviated wells. Due to gravitational effects and settling of proppant it is possible that e values for deviated wells may be higher.

The correlation shown by Eq. (28) can be used to calculate the values of proppant friction coefficient e, which can tremendously aid in generating the BHP or net pressures in the absence of dead strings or BHP gauge. The base-gel friction can be obtained by using the ISIP technique described in the text above.

These calculations can be programmed on a spreadsheet for easy field use or, according to a preferred embodiment of the present invention, integrated into a design software such as FracCADE (mark of Schlumberger). This can be carried out in two ways. Firstly, for the design mode, inbuilt calculator that makes use of input values of proppant, concentration, proppant specific gravity, tubular diameter and the rate at which the job has to be pumped can provide the e values. Provision can be made for the user to input his own e values if he is not satisfied with the correlation-obtained value.

Provision can be made for the user to click on these values and define the surface pressures, or it could also be automatic. As soon as the real time data has a minimum of three data points, the user can calculate friction multipliers and thus compute the e value for an averaged rate and proppant volume fraction. If real-time pressure match is run at this point, the software will suggest this value to the user.

What is claimed is:

1. A method of determining proppant friction generated in a fracture of a subterranean formation during a hydraulic fracturing treatment involving injection stages of pad and of proppant-laden fluids comprising the steps of:

a) close monitoring of surface pressure to define a net pressure rate;

b) determining a net pressure from the net pressure rate while pumping a job; and c) correlating said net pressure rate with pressure changes observed with the onset of proppant stages of varying concentrations.

2. The method of claim 1, wherein the net pressure rate is equal to the increase of surface pressure during one tubing volume over a stabilized surface pressure measured during the pumping of a pad stage.

3. The method of claim 2, wherein the proppant friction is the difference between an ideal hydrostatic drop, based on fluid density and the stabilized surface pressure measured during a proppant stage, increased by the net pressure.

* * * * *